United States Patent [19]

Parma

[11] 4,398,512

[45] Aug. 16, 1983

[54] INTERNAL COMBUSTION ENGINES AND ROTARY VOLUMETRIC COMPRESSORS

[76] Inventor: Agustin M. Parma, Luis Alberto De Herrana 2641, Montevideo, Uruguay

[21] Appl. No.: 177,101

[22] Filed: Aug. 11, 1980

[30] Foreign Application Priority Data

Aug. 23, 1979 [UY] Uruguay ..... 20937

[51] Int. Cl.[3] ..... F02B 53/00

[52] U.S. Cl. ..... 123/245; 418/35

[58] Field of Search ..... 123/24 J; 418/33, 35

[56] References Cited

U.S. PATENT DOCUMENTS

| | | | |
|---|---|---|---|
| 1,354,402 | 9/1920 | Johnson | 418/36 |
| 2,670,688 | 3/1954 | Graham | 418/35 X |
| 4,137,891 | 2/1979 | Dalrymple | 418/35 X |

FOREIGN PATENT DOCUMENTS

| | | | |
|---|---|---|---|
| 496472 | 7/1954 | Italy | 418/35 |

*Primary Examiner*—Michael Koczo

*Attorney, Agent, or Firm*—Holman & Stern

[57] ABSTRACT

This invention relates to rotary compressors or rotary engines, and comprises essentially a cylindrical rotor mounted concentrically within a cylindrical casing with an annulus therebetween. A plurality of cylindrical rollers revolve through the annulus to function as the compressor means, when the device is used as a compressor, or the driving force when used as an engine. Intake and exhaust valves are provided and in the case of an engine, electric circuit and power means together with distributor, spark plug and valve operating means are provided to operate in predetermined timed sequence.

6 Claims, 4 Drawing Figures

INTERNAL COMBUSTION ENGINES AND ROTARY VOLUMETRIC COMPRESSORS

FIELD OF THE INVENTION

The present invention relates to a rotary mechanism which introduces improvements in internal combustion engines and in volumetric compressors, of the rotary type, which comprise a new combination of functional elements permitting the elimination of a large part of the functional means grouped together in conventional engines and compressors of the stated type, thus simplifying the mechanism.

The object of this invention is to provide a rotary mechanism which replaces the piston, connecting rod and crankshaft or sliding vanes of the classic internal combustion engines and compressors.

DESCRIPTION OF THE PRIOR ART

Various types of rotary volumetric compressors and engines are known; among the engines may be cited those which comprises an almost triangular rotor which rotates eccentrically, its three generatrices rubbing inside a casing of flattened form, driven by a crankshaft, said rotor producing a variable volume due to its eccentric movement inside the casing. And among the compressors, those which comprise a cylindrical rotor equipped with several sliding vanes, which rotates inside a cylinder whose axis is not concentric with that of the rotor, and due to the centrifugal force the vanes engage at their outer edges of the inner surface of the outer cylinder, thus producing a variable volume.

BRIEF SUMMARY OF THE INVENTION

The improvements embodied by the mechanism of the present invention eliminate many of the elements of the conventional mechanism referred to and provide parts of easy construction and long service life. In this mechanism a cylinder serves as a rotor which rotates concentrically inside another fixed cylinder which serves as a casing. In the annulus between the two cylinders revolve two or more hollow cylindrical rollers of small mass. To produce compression between the rollers, at least one is releasably held in fixed position by providing on the internal surface of the outer cylinder, or casing, one or more fluted slots. The rollers are compressed between the rotor and outer cylinders so that when the rotor turns the rollers revolve in the annulus due to friction. When a roller reaches a slot, it is no longer compressed between the rotor and outer cylinder and stops and the roller skids against the rotor, while the other roller or rollers continue to revolve, compressing the fluid in the annulus between the stopped roller and the advancing side of the moving roller.

Two or more rollers may be used to produce different combinations of parts to function as an internal combustion engine, or simply a compressor as desired.

BRIEF DESCRIPTION OF THE SEVERAL VIEWS OF THE DRAWINGS

In all these figures, the same reference numbers indicate equal or corresponding parts.

DETAILED DESCRIPTION

Figure 1:
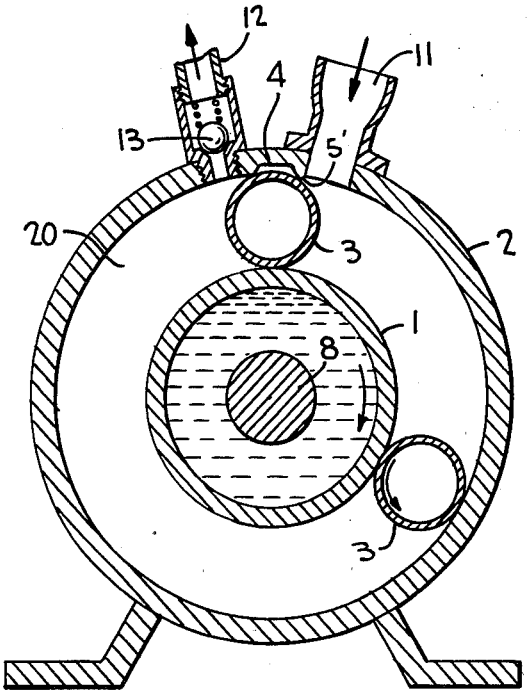
FIG. 1 is a transverse sectional view through the mechanism of the invention as applied to a compressor.
Figure 3:
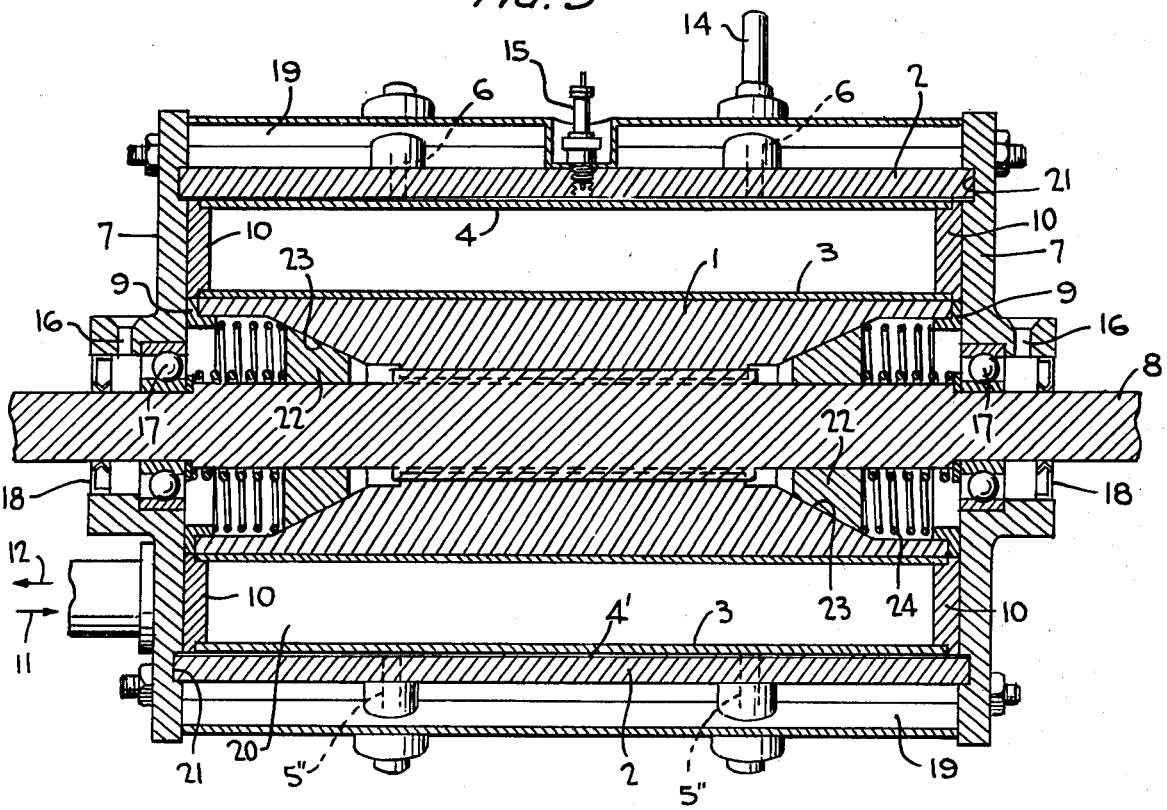
FIG. 3 is a longitudinal section through the engine of FIG. 2.

The invention will now be more specifically described with reference to the drawings. FIG. 1 shows an embodiment functioning as a compressor wherein cylindrical rotor 1 is mounted for coaxial rotation within cylindrical casing 2 in spaced relationship to provide an annular space between the two cylindrical members. Cylindrical rollers 3, two being shown in FIG.1, are disposed within the annulus 20 in frictional rolling contact with the outer surface of rotor 1 and the inner surface of casing 2 so that they are driven in a cylindrical path through the annulus in revolving fashion by rotation of rotor 1. Rotor 1 may be a cylindrical member mounted on a drive shaft 8, as shown in the embodiment of FIG. 3, or may be of one-piece construction having an integral drive shaft. The drive shaft 8 is mounted at its ends for rotation by bearings 17, as shown in FIG. 3, as will later be more fully described. In the case of a compressor, drive shaft 8 may be driven by any suitable means, such as an electric motor for example.

A longitudinal slot 4 is provided on the inner surface of casing 2 of a width and depth sufficient to releasably retain one roller 3 when engaged thereby in a stationary position with respect to its circular path of travel through annulus 20. Intake port 11 and exhaust port 12 are provided through the casing 2 on opposite sides and in close proximity to slot 4, the exhaust port being closed by a suitable valve such as the spring urged ball check valve 13, the spring being adjustable so that the valve can be set to open at any desired pressure. In this instance, the intake has no valve but remains open and is on the right side of slot 4 since the rotor is driven clockwise.

In operation of the compressor of FIG. 1, as the motor-driven rotor rotates, one roller is trapped in the slot and the other roller is driven clockwise through the annulus 20 between the rotor and casing simultaneously producing two variable chambers, the admission chamber which communicates with the exterior through intake port 11 which remains constantly open and the compression chamber between the advancing roller and the stationary roller held by slot 4. Thus, as the moving roller approaches the stationary one air intake occurs through port 11 and the air which had entered in the preceding cycle trapped between the rollers is compressed. Eventually, the revolving roller contacts the stationary one and drives it from the slot 4 and is itself trapped therein as it passes over it. To avoid a direct collision between the two rollers, it is possible to regulate the retention of the trapped roller by means of a pawl 5 (see FIG. 2) actuated by an adjustable spring, such that the compression of the air itself causes the trapped roller to escape. This pawl, which may be one or several located along a generatrix of the casing, parallel and close to the slot, cooperates with the slot to retain the roller. This pawl may be replaced by a rigid stop 5' on the interior of the casing along its generatrix and close to the edge of the slot, such that it reduces the radius of the casing, preventing the trapped roller from coming out of said slot, but in this case the rotor-roller assembly must absorb the entire deformation as the roller leaving the slot passes over that small stop. The rollers must have a certain degree of flexibility on being compressed in order to obtain good sealing and frictional contact with the rotor and casing and so that they will not skid against the rotor. The material of the rollers must also be compatible with the fluid being compressed; it may range from synthetic rubbers to high flexibility steels. The roller trapped in the slot also maintains the seal, for although it is not compressed like the one which revolves, it contacts the edge of the slot over an entire generatrix and against the rotor where the two surfaces in contact may slide.

The use of a pawl 5 in no way affects the sealing in the compression chamber, provided its dimensions are not too large, for it is located on a generatrix of the casing next to the slot on the intake side and the communication of the guide of the pawl with the exterior is retained by the screw which regulates the spring pressure as desired. The rotor, casing and rollers are held in proper relationship to each other by end caps 7, as shown in FIG. 3, which also support the bearings 17 in which shaft 8 is mounted. End caps 7 have circular slots 21 to sealingly engage the ends of casing 2. To avoid leaks across the ends of the rotor, cylindrical antifriction seal rings 9 of adequate cross section are disposed at said ends so that they will maintain the seal despite their wear as they constantly rub against the end caps 7. Stops must be applied to them so they will not slide against the rotor, because only the surface in contact with the casing caps should undergo wear. Likewise, to avoid leaks across the rollers, it is necessary to place elastic or rigid antifriction elements 10 actuated by springs on both ends of each roller, where it rubs against the end caps 7.

The sliding surfaces must be lubricated and this is achieved by circulating oil, which is introduced through oil holes 16 in end caps 7, inside the rotor which is hollow thereby permitting the bearings thereof and the rings to be lubricated, and the oil which in small quantities passes through these rings permits lubricating the surface of the rollers and the rotor. Seals 18 are provided in the end caps 7 to prevent the oil from leaking by the shaft 8.

To obtain adequate compression of the rollers between the casing and the rotor, conical members 22 may be slidably disposed on the rotor shaft 8 to engage conical seats 23 on the interior surface of expandable rotor cylinder 1. Members 22 may be urged by springs 24 against the conical seats 22 to wedge the rotor member radially outwardly and compress the rollers between the rotor and the casing, this compression being a direct function of the force of the springs and of the angle of the conical surface.

For transmission of torque between the shaft and the cylinder which forms the rotor, a splined connection may be used between the two parts, with the necessary clearance at the ends for the conical pieces to be able to operate.

This mechanism by itself reduces the speed of the motor which impels the compressor, because with every revolution of the rotor the roller does not pass over the entire surface of the outer cylinder, but only a part thereof, it being possible to regulate that reduction by changing the diameters of the rotor and rollers. It is evident that this compressor is adaptable to any type of fluid or can work as a vacuum pump. In addition, if a pressure fluid is injected through the intake, a power stroke (motor energy) is obtained on the shaft, in which case the check valves are unnecessary.

Figure 2:
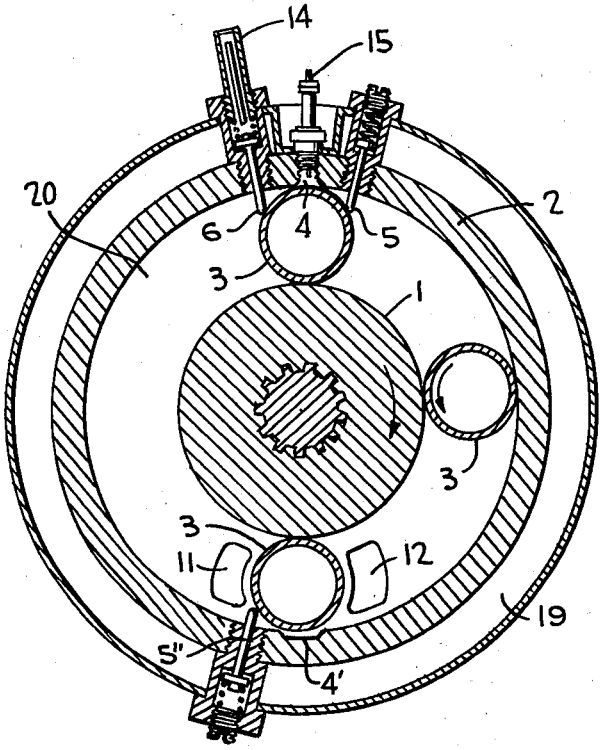
FIG. 2 is a transverse sectional view through the mechanism of the invention as applied to an engine.
Figure 4:
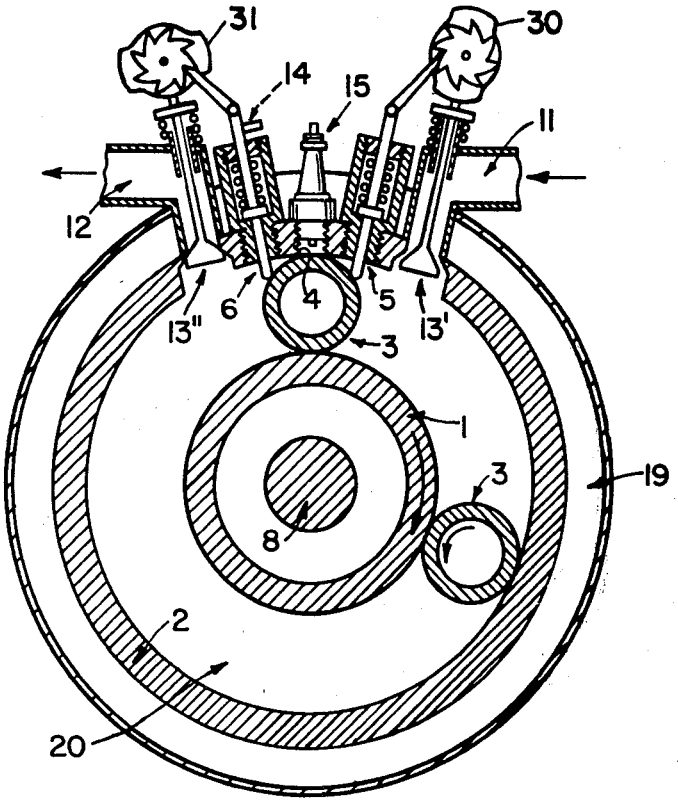
FIG. 4 is a transverse cross-sectional view of the invention as applied to a second embodiment of an engine.

FIGS. 2, 3 and 4 illustrate the application of the invention to an internal combustion engine particularly the type utilizing the Otto cycle, it being realized that it is also applicable to a Diesel cycle. FIGS. 2 and 3 show three rollers, but it is to be understood that two rollers may be used as shown in FIG. 4 in which case the parts function similarly in principle to the compressor, although, there must be added a pawl 5, an inlet valve 13', an exhaust valve 13'', a pawl 6, a spark plug 15, and an electric distributor 14 which is actuated by pawl 6 of this design. The pawls are adjacent to the slot 4 which traps one of the rollers, but must be on opposite sides of said slot. More than one of each pawl may be used as shown in FIG. 3.

The added function of the pawl 6 is to prevent the trapped roller from moving back when the combustion of the fuel takes place and it also serves to control the valves and the distributor, because this pawl communicates to an exterior actuating means such as a lever which controls the valves (not shown).

The spark plug is installed over and in communication with the slot 4 in the casing.

A flywheel (not shown) must be mounted on the rotor shaft as in any engine, as well as the electric circuit for energizing and firing the spark plug at the proper instant. Of course the intake is connected to a carburetor (not shown) suitable for supplying the proper fuel mixture. A water jacket 19 may be provided as a cylindrical member surrounding the casing member 2.

As in the case of a compressor, FIG. 4 shows that there are two simultaneous variable chambers, and it is to be understood in one complete rotation of the roller over the entire surface of the cylinder (revolution) which is the casing 2, which, as we have seen, does not coincide with a revolution of the rotor, the simultaneous operations carried out by each revolution are the following: intake-expulsion, intake-compression, explosion-compression, explosion-expulsion; that is, there are two complete staggered cycles in one stroke, this being obtained by suitable control of the valves.

With reference to FIG. 4, with the rotor rotating clockwise and the slot 4 which traps the roller at the top of FIG. 2, to the left of that slot is the exhaust valve 13' and the controlling retention pawl 6, and on the right side is the inlet valve 13'' and the pawl 5 which regulates the compression, identical with that of a compressor, which we shall simply call the compression pawl. The pawls and valves may be respectively connected through a timing mechanism having cams 30, 31 which contact the valves, for example. In the first revolution on the right side the intake valve is open from the carburetor and gas is expelled through the exhaust valve. In the second revolution fuel is still taken in on the right side through the open intake valve while on the other side the exhaust valve is closed and the intake of the previous revolution is compressed. In the third revolution the spark plug explodes the previously compressed fuel mixture on the right side and on the other side the fuel mixture taken in in the second revolution is compressed. In the fourth revolution, the spark plug explodes the mixture compressed in the preceding revolution and on the other side the gases produced in the explosion of the third revolution are expelled. Then the cycles begin again.

The compression ratio of this engine can be regulated by the depth of the slot and by varying as desired the pressure of the spring which actuates the compression pawl 5.

When the explosion occurs, the roller trapped in the slot cannot move back due to the controlling retention pawl 6 and due to the reaction of the rotor and the friction which pushes the latter against the roller toward the side opposed to the expanding force of the gases.

On the other hand, the roller which rolls as it receives the pressure of the gases produced by the explosion transmits to the rotor a motor energy, for this roller is compressed between the casing and rotor, the rolling friction being very high.

When three roller are used, as shown in FIGS. 2 and 3, two diametrically opposite slots 4 and 4' are provided in the casing so that two rollers are always trapped and only one revolves at any one time. This greatly simplifies the mechanism because no valves are required with their entire drive mechanism, as the inlet and exhaust ports are constantly open. Only the electric distributor with the electric circuit for firing the spark plug is required. Next to the slot over which the spark plug is placed, two pawls 5 and 6 are installed, as in the engine with two rollers, but in this case there are no openings or valves at that position. At the other slot 4' (near the bottom in FIG. 2), instead, there is only one pawl 5'', and to the left side of that slot is the inlet port 11 connected to the carburetor, and on the right side the exhaust port 12, both constantly open. With the rotor rotating clockwise at regular speed, and the slot with the spark plug at the top, assuming several revolutions have taken place, in the first cycle when a first roller leaves the lower slot, it draws in fuel mixture behind it and compresses in front of it the mixture taken in in the preceding cycle as it approaches a second roller trapped in the upper slot which has the spark plug. When it reaches the retention pawl 6, the latter actuates the distributor and the spark plug fires detonating the compressed mixture, which impels the second roller which was in the upper slot. The spark plug should fire at the moment when the first roller enters the slot, that is, after passing the pawl to prevent it from moving back as the explosion occurs. This second roller which is impelled by the force of the explosion is the one which transmits the motor energy to the rotor, and in its turn ahead of it expels the gases produced in the preceding cycle, through the exhaust port 12 as it approaches the third roller trapped in the lower slot 4'. When it reaches the slot 4', the second roller is trapped therein and the third rolls out, thereby starting another cycle, drawing fuel in behind it and compressing in front of it the mixture taken in by the first roller.

In Diesel cycle engines the present invention is applicable by replacing the distributor and spark plug of the Otto cycle by an injection pump and injector, actuated by the retention control pawl 6, mentioned above.

It is to be understood that the present invention is not in any way limited to the examples described and represented, but that various modification of form and/or detail may be made without departing from the scope of this invention which is only determined by the claims which follow this description.

What is claimed is:

1. In a rotary fluid displacement mechanism having a rotor which is driven and being provided with an intake port and an exhaust port, the improvement comprising a hollow cylindrical casing in which said ports are located in close proximity to each other, a cylindrical rotor concentrically mounted within said casing to provide a cylindrical annulus between the rotor and casing, end caps sealingly engaging the ends of said casing, at least two cylindrical rollers within said annulus compressed between the rotor and inner surface of the casing so that rotation of the rotor drives each roller in a circular revolution through the annulus, means to releasably retain said rollers intermittently one at a time while the other is free to revolve, said releasable retaining means being located between the intake and exhaust ports to provide two simultaneously variable chambers in the annulus between the rollers, a shaft disposed concentrically within said rotor on which said rotor is mounted, bearing means in said end caps for mounting said shaft for rotation and said rotor comprising a radially expandable cylinder, a conical seat near each end of and within said cylinder the larger diameter of which is nearer the end, a conical wedge member within each seat in cooperative engagement therewith and slidably mounted on said shaft, a helical spring mounted on said shaft between the base of each wedge member and the respective end of said cylinder to resiliently urge said wedge members towards the center of said cylinder to thereby produce a radially expanding force on said cylinder, and a sliding splined connection between said shaft and said cylinder and between said conical seats, said splined connection having radial clearance between said shaft and rotor to facilitate providing a radial resilient force on said rollers.

2. A rotary fluid displacement device in accordance with claim 1 and further comprising an external drive means for rotatively driving said shaft, a check valve in said exhaust port, seal means to seal the annulus at its ends, said releasable retaining means comprising a longitudinal slot in the inner surface of the casing, said slot having a width and depth sufficient to stop a roller engaged therein from continuously revolving through the annulus until a predetermined force is applied to the roller to disengage it from the slot.

3. A rotary fluid displacement device according to claim 2, wherein an enlarged shoulder is provided on the intake side of the slot to assist the slot in releasably retaining a roller therein and the rollers are compressible.

4. A rotary fluid displacement device in accordance with claim 1 including a spark plug and a source of electrical energy for said spark plug and further comprising means to seal he annulus at its ends, two rollers in the annulus, the releasable retaining means is a longitudinal slot in the inner surface of the cylindrical member located between the intake and exhaust ports having a width and depth sufficient to stop a roller engaged therein from continuously revolving through the annulus until a predetermined force is applied to the roller to disengage it from the slot, an intake valve in the intake port and an exhaust valve in the exhaust port, a spring urged releasable pawl engaging the exhaust side of the roller engaged in said slot to prevent it from counter-revolving in the annulus, a spark plug extending through the casing into said slot, means to supply a fuel mixture to the intake port, means responsive to the position of said pawl to open and close said valves in timed sequence, and distributor means responsive to the position of said pawl to fire the spark plug in timed sequence with the opening and closing of the valves so that the spark plug is fired after the roller in the slot has been disengaged so that said roller is propelled through the annulus by the force of the explosive burning of the fuel mixture.

5. A rotary fluid displacement device according to claim 2, wherein said releasable retaining means further comprises a spring urged pawl mounted in said casing and engaging the roller held in said slot on its intake side.

6. A rotary fluid displacement device as claimed in claim 5 wherein said spring urged pawl comprises a pin member extending radially through said casing, a spring urging said pin member radially inwardly, and means to adjust the force of said spring.

* * * * *